US005979790A

United States Patent [19]

Gürich et al.

[11] Patent Number: 5,979,790

[45] Date of Patent: Nov. 9, 1999

[54] CONTROLLABLE FUEL INJECTION VALVE FOR AN INTERNAL-COMBUSTION ENGINE

[75] Inventors: Gunter Gürich; Martin Düsterhöft, both of Aachen; Hermann Josef Laumen, Heinsberg, all of Germany

[73] Assignee: FEV Motorentechnik GmbH & Co. KG, Aachen, Germany

[21] Appl. No.: 09/074,398

[22] Filed: May 8, 1998

[30] Foreign Application Priority Data

May 9, 1997 [DE] Germany ..... 297 08 369

[51] Int. Cl.[6] ..... F02M 47/02; F02M 59/00

[52] U.S. Cl. ..... 239/88; 239/533.2

[58] Field of Search ..... 239/88–92, 95, 239/96, 124, 126, 533.1, 533.2, 533.3, 533.5, 533.12, 533.9, 533.15, 570, 583, 584

[56] References Cited

U.S. PATENT DOCUMENTS

| | | | |
|---|---|---|---|
| 4,465,231 | 8/1984 | Sharp | 239/533.5 |
| 5,255,845 | 10/1993 | Brunel | 239/90 |
| 5,282,574 | 2/1994 | Koch | 239/90 |
| 5,779,149 | 7/1998 | Hayes, Jr. | 239/88 |

FOREIGN PATENT DOCUMENTS

| | | | |
|---|---|---|---|
| 0002458 | 1/1982 | Japan | 239/533.9 |

*Primary Examiner*—Andres Kashnikow
*Assistant Examiner*—Jooge Bocanegra
*Attorney, Agent, or Firm*—Venable; Gabor J. Kelemen

[57] ABSTRACT

A fuel injection valve for an internal combustion engine includes a valve block; an injection nozzle carried by the valve block and having a nozzle opening; a valve needle slidable in the injection nozzle for assuming closed and open positions to block and, respectively, to unblock the nozzle opening; a closing spring urging the valve needle into the closed position; and a pressurized fluid port in the valve block. The nozzle opening is in communication with the pressurized fluid port in the open position of the valve needle. A discharge port is defined in the valve block for carrying fluid away therefrom. An equalizing piston, which is slidably disposed in a work chamber in the valve block, is connected with the valve needle. A control plunger is movable in the valve block and has a first position and a second position. In the first position the control plunger prevents communication between the discharge port and the work chamber and maintains communication between the pressurized fluid port and the work chamber for maintaining the equalizing piston and the valve needle in the closed position. In the second position the control plunger prevents communication between the pressurized fluid port and the work chamber and maintains communication between the discharge port and the work chamber for moving the equalizing piston and the valve needle into the open position. A throttle is disposed in the discharge port for braking fluid flow from the work chamber through the discharge port.

4 Claims, 2 Drawing Sheets

CONTROLLABLE FUEL INJECTION VALVE FOR AN INTERNAL-COMBUSTION ENGINE

CROSS REFERENCE TO RELATED APPLICATION

This application claims the priority of German Application No. 297 08 369.4 filed May 9, 1997, which is incorporated herein by reference.

BACKGROUND OF THE INVENTION

In a fuel injection system for injecting fuel into an internal-combustion engine the fuel injection valves of individual cylinders are frequently coupled to a common pressure accumulator for obtaining fuel therefrom.

Each fuel injection valve is provided with a valve needle (nozzle needle) which is coupled to a controllable setting drive and which thus closes (blocks) or opens (unblocks) the fuel outlet opening of the nozzle. During operation, the valve needle is exposed to a liquid pressure of, for example, 1500 bar so that for achieving short and reproducible control periods in the opening and closing processes, between the valve needle and the setting drive conventionally a pressure compensating piston is arranged for moving the valve needle with a reduced pressure. The pressure equalizing piston is, dependent on the switching position of the control valve, coupled either with the pressure accumulator or with a fuel return (discharge) conduit. In this arrangement care has to be taken that the control valve is so designed that it is pressure balanced relative to the pressure accumulator, the fuel return conduit and the pressure equalizing piston.

Conventional valve arrangements of the above-outlined type have the disadvantage that during the switching process the control valve briefly assumes an intermediate position, so that the high-pressure side is directly in communication with the low-pressure side of the system. This leads, in phase with the switching motion, to appreciable pressure drops in the pressure accumulator. Since in a multi-cylinder engine a plurality of fuel injection valves are present, in the pressure accumulator pressure fluctuations occur at the frequency of the cycling sequence of all the fuel injection valves. Such oscillation phenomena in the application of pressure, however, affect the switching behavior of the valves and may lead to non-reproducible magnitudes in the periods of injection and the quantities of the injected fuel at the individual valves.

SUMMARY OF THE INVENTION

It is an object of the invention to provide an improved fuel injection valve of the above-outlined type from which the described oscillation phenomena in the pressure system are eliminated or minimized to such an extent that a highly satisfactory operation of the fuel injection valve is ensured.

This object and others to become apparent as the specification progresses, are accomplished by the invention, according to which, briefly stated, the fuel injection valve for an internal combustion engine includes a valve block; an injection nozzle carried by the valve block and having a nozzle opening; a valve needle slidable in the injection nozzle for assuming closed and open positions to block and, respectively, to unblock the nozzle opening; a closing spring urging the valve needle into the closed position; and a pressurized fluid port in the valve block. The nozzle opening is in communication with the pressurized fluid port in the open position of the valve needle. A discharge port is defined in the valve block for carrying fluid away therefrom. An equalizing piston, which is slidably disposed in a work chamber in the valve block, is connected with the valve needle. A control plunger is movable in the valve block and has a first position and a second position. In the first position the control plunger prevents communication between the discharge port and the work chamber and maintains communication between the pressurized fluid port and the work chamber for maintaining the equalizing piston and the valve needle in the closed position. In the second position the control plunger prevents communication between the pressurized fluid port and the work chamber and maintains communication between the discharge port and the work chamber for moving the equalizing piston and the valve needle into the open position. A throttle is disposed in the discharge port for braking fluid flow from the work chamber through the discharge port.

By arranging a throttle in the fluid return conduit of the control valve, it is ensured that upon motion of the control plunger—in the course of which the pressurized fluid supply conduit and the fluid return conduit are briefly directly coupled to one another—the outflow (discharge) of the fluid is minimized by the throttle effect and is thus delayed so that the pressure drop at the pressure side of the system is minimized. As a result, a pressure oscillation (that is, the generation of pressure waves) is practically eliminated.

According to a preferred embodiment of the invention, the control plunger of the control valve is guided in a plunger housing and is connected with the setting drive. Further, the control plunger has two axially spaced first and second pistons which have identical piston faces and which are guided in separate pressure chambers. One of the pressure chambers communicates with the pressure supply conduit and the other communicates with the pressure return conduit and further, the two pressure chambers are coupled to one another by a transfer chamber which is connected by means of a coupling conduit with the work chamber in which the equalizing piston is accommodated. The transfer chamber is provided with sealing edges at those two locations where the pressure chambers bound the transfer chamber. The control plunger further has a third, or blocking piston flanked by the first and the second pistons and accommodated in the transfer chamber. Dependent on the position of the control plunger, the blocking piston engages the one or the other sealing edge and thus seals the respective pressure chamber from the transfer chamber and further, the throttle is disposed in the fluid return conduit of one of the pressure chambers. Such an arrangement ensures that the control plunger is guided in a de-pressurized manner and that, dependent upon the dimensions of the throttle, in the short period in which the blocking piston is not in engagement with either the one or the other sealing edge, that is, a direct hydraulic communication exists between the pressurized fluid supply conduit and the fluid return conduit, only a small quantity of fluid may flow from the high pressure side to the low pressure side.

According to a further feature of the invention, the valve block is a two-part housing structure; each part defines a pressure chamber and further wherein the transfer chamber is bounded by a replaceable disk against which the two housing parts are pressed. By inserting disks of different thicknesses the stroke of the blocking piston may be adapted to the prevailing conditions. The replaceable disk at the same time constitutes a seal between the two housing parts and bounds the transfer chamber with its inner periphery.

According to another advantageous feature of the invention, the two housing parts are sleeve-like components inserted telescopically into one another and further, between the two housing parts a replaceable intermediate layer is arranged for setting the mutual distance between the two sealing edges and further, the disk which bounds the transfer chamber is made of an elastically deformable material. By virtue of such an arrangement the disk which bounds the transfer chamber has solely a sealing function and therefore it may be made of a soft material. The function of setting the distance between the two sealing edges is effected by the thickness of the intermediate layer.

DESCRIPTION OF THE PREFERRED EMBODIMENT

Figure 1:
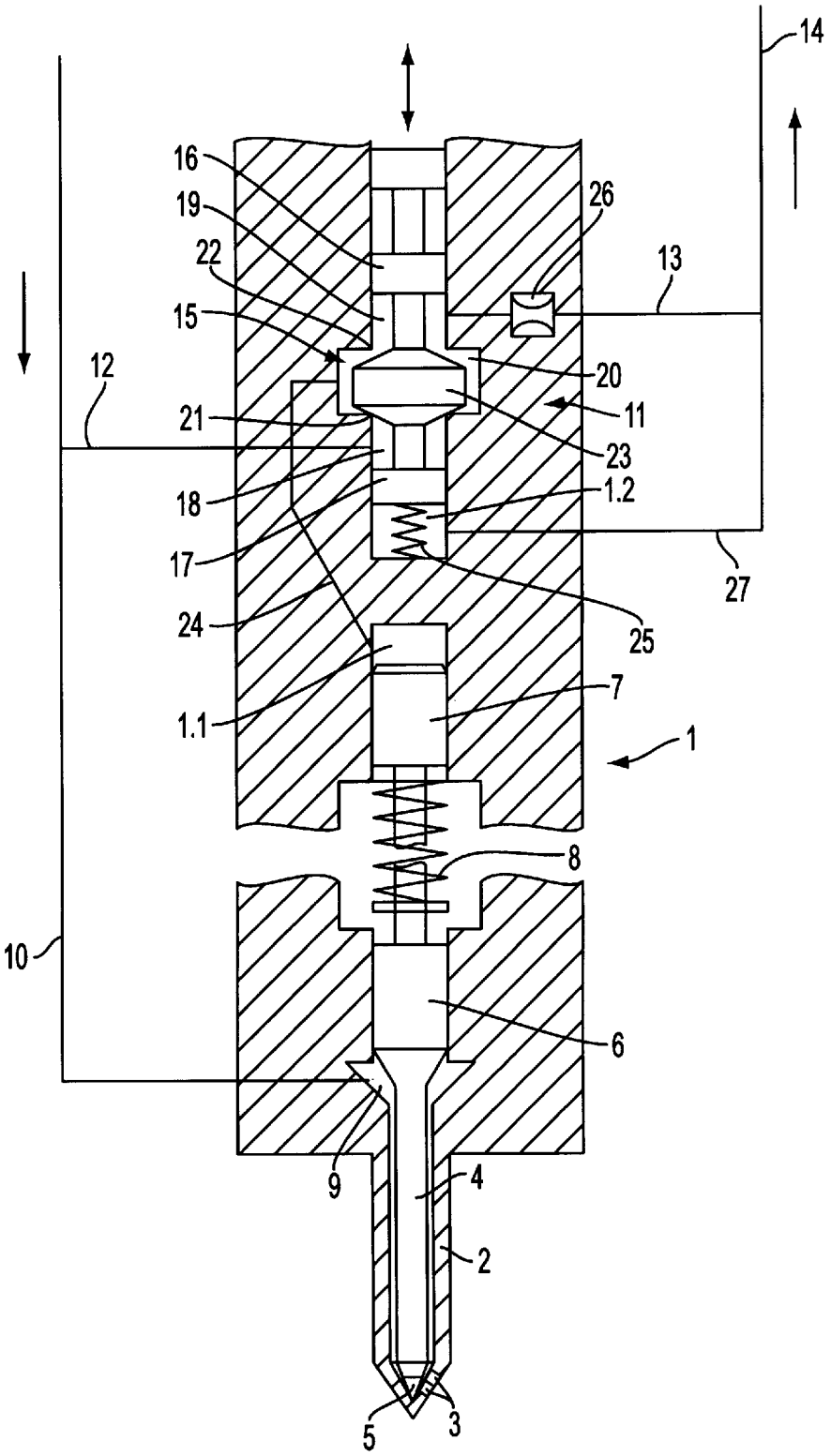
FIG. 1 is a schematic axial sectional view of a fuel injection valve, illustrating the principle of the invention.

Turning to FIG. 1, the fuel injection valve shown therein includes a valve block 1 and an injection nozzle 2 provided with a nozzle opening 3. In the valve block 1 a valve needle 4 is axially slidably guided which, in the depicted position, closes the nozzle opening 3 with its needle tip 5 which acts as a valve.

The valve needle 4 is connected with an opening piston 6 and a pressure equalizing piston 7 which is axially spaced from the opening piston 6 and which is axially slidable in a work chamber 1.1. The components 4, 6 and 7 form a one-piece construction. A closing spring 8 urges the valve needle 4 into the shown closed position.

The valve needle 4 is, at a distance from the nozzle opening 3, surrounded by an annular chamber 9 which communicates with a pressurized fluid supply conduit (port) 10 which, in turn, is connected to a pressure accumulator so that upon opening of the valve needle 4, pressurized fluid, for example, liquid fuel, may enter from the pressure accumulator through the nozzle opening 3 into the associated cylinder chamber of an internal-combustion engine.

To open and close the valve needle 4, in the valve block 1 a control valve 11 is disposed which, in the embodiment illustrated, is expediently arranged in axial alignment with the valve needle 4. The control valve 11 is in communication by a branch conduit 12 with the pressurized fluid supply conduit 10 and is thus in communication with the pressure accumulator. The control valve 11 is also in communication with a low-pressure fluid discharge conduit (port) 14 by means of a conduit 13.

The control valve 11 is essentially formed of a control plunger 15 composed of first and second pistons 16, 17 and a blocking piston 23, flanked by the pistons 16, 17. The blocking piston 23 is movable in a transfer chamber 20 while the two pistons 16 and 17, which have identical piston faces, are guided in respective pressure chambers 19 and 18 which are in communication with the transfer chamber 20 separated from the respective work chambers 18 and 19 by sealing edges 21 and 22.

The blocking piston 23 of the control plunger 15, dependent upon its position, engages the one or the other of the two sealing edges 21 and 22 and, accordingly, seals the respective pressure chamber 18 or 19 from the transfer chamber 20.

The pressure chamber 18 is connected with the pressure accumulator by means of a conduit 12 while the pressure chamber 19 is connected by the conduit 13 with the low-pressure (discharge) conduit 14. The transfer chamber 20 is coupled with the work chamber 1.1 of the pressure, equalizing piston 7 by means of a transfer port 24.

The control plunger 15 is connected at its free end oriented away from the nozzle opening 3 with a conventional setting drive (not shown in FIG. 1) which applies its force to the control plunger 15 by mechanical, magnetic or hydraulic means.

The control plunger 15 has, at its side oriented away from the setting drive, a resetting spring 25 which, when the setting drive is de-energized, presses the blocking piston 23 against the sealing edge 22 which borders the pressure chamber 19. In this manner the pressure equalizing piston 7 is charged with high pressure through the conduit 12, the pressure chamber 18, the transfer chamber 20 and the transfer port 24. Since at the same time the opening piston 6 of the valve needle 4 is charged with the same, opposite pressure from the pressure chamber 9, it is ensured that the valve needle 4 is held in a de-pressurized state in its closed position by the closing spring 8.

If by means of the setting drive (not shown in FIG. 1) the blocking piston 23 is brought into engagement with the sealing edge 21 of the pressure chamber 18 as illustrated in FIG. 1, the transfer chamber 20 is sealed from the pressurized fluid supply conduit 12 while at the same time the transfer chamber 20 is made to communicate with the low-pressure (discharge) conduit 14 through the pressure chamber 19 and the conduit 13. In this manner the work chamber 1.1 of the pressure equalizing piston 7 too, is connected with the discharge conduit 14 through the transfer port 24, the transfer chamber 20, the low-pressure chamber 19 and the conduit 13. As a result, of the unitary piston assembly 6, 7 only the opening piston 6 is charged by a high fluid pressure from the chamber 9, and thus the piston assembly 6, 7 is lifted against the force of the closing spring 8 so that the tip 5 of the valve needle 4 moves away and thus opens the nozzle opening 3.

Since during the switching motion of the control plunger 15 the high-pressure side (that is, the pressurized fluid supply conduit 10) is briefly in communication with the low-pressure side (that is, the fluid discharge conduit 14) and thus a direct discharge of the pressurized fluid may take place towards the low-pressure side, in the fluid discharge conduit 13 the throttle 26 is arranged which, dependent upon its design, reduces the flow rate of the direct discharge of the pressurized fluid from the high-pressure side until the blocking piston 23 arrives into a sealing engagement with the sealing edge 21. Thereafter the fluid may flow towards the low-pressure side under the effect of the high-pressure side affecting the opening piston 6. Since the outflow from the work chamber 1.1 of the pressure equalizing piston 7 is also reduced, the opening motion of the valve needle 4 is braked.

The discharge flow-delaying effect of the throttle 26 appears also when, upon resetting the control plunger 15, the blocking piston 23 moves towards the other side (that is, towards the sealing edge 22) and the pressure equalizing piston 7 of the valve needle 4 is again charged with high pressure from the pressure accumulator. The closing motion of the valve needle 4 is not delayed by the throttle.

The throttle 26 thus ensures that during the switching motion of the control plunger 15 no appreciable pressure drop in the high-pressure region appears which otherwise would lead to pressure oscillations (wave-like pressure thrusts) in the fluid system.

The receiving chamber 1.2 for the resetting spring 25, situated at the non-pressurized side of the piston 17 is connected with the discharge conduit 14 by a conduit 27.

Figure 2:
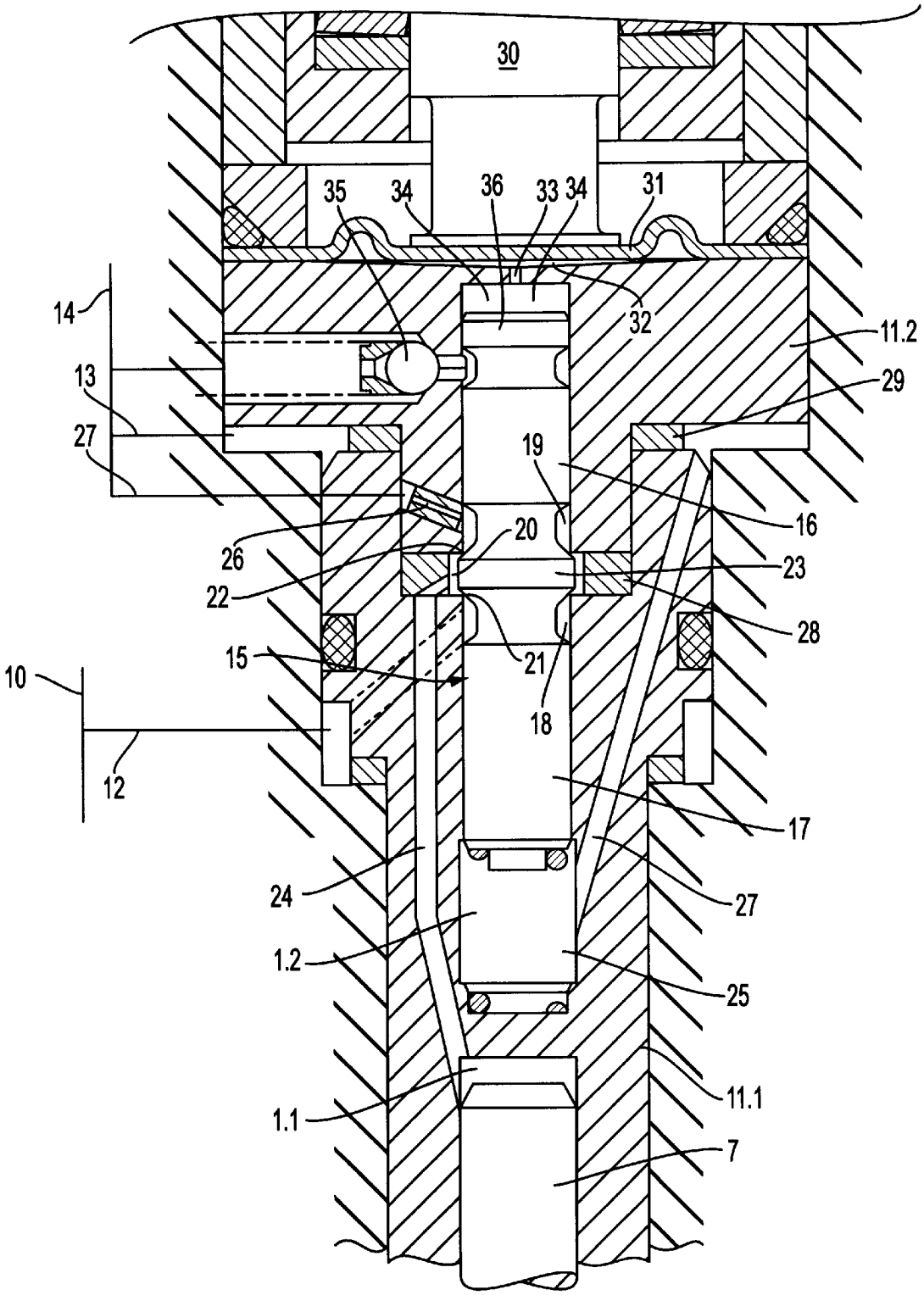
FIG. 2 is an axial sectional view of one part of a fuel injection valve illustrating a preferred embodiment of the invention.

Turning to a particular structural embodiment of the invention illustrated in FIG. 2, for the control valve 11 a two-part valve block is provided which is formed essentially by two sleeve-like housing parts 11.1 and 11.2. The housing part 11.1 defines the pressure chamber 18 and thus accommodates the piston 17 of the control plunger 15 and also defines the work chamber 1.1 and thus accommodates the equalizing piston 7 of the valve needle 4. The housing part 11.2 is telescopically inserted into a corresponding opening of the housing part 11.1 and between the two housing parts a replaceable disk 28 is arranged, whose inner periphery defines the transfer chamber 20. The disk 28 may be made of a non-deformable material so that by virtue of the thickness of the disk the distance of the two sealing edges 21 and 22 from one another and thus the stroke of the blocking piston 23 may be set. The disk 28 simultaneously performs a sealing function.

In the illustrated embodiment, however, the disk 28 is made of an elastically deformable material and between the two housing parts 11.1 and 11.2 an intermediate layer 29 made of a non-deformable material is provided. The predetermined thickness of the intermediate layer 29 defines the distance of the two sealing edges 21 and 22 from one another and thus the stroke of the blocking piston 23 may be set, while the elastic disk 28 only performs a sealing function.

In the embodiment shown in FIG. 2 the setting drive for the control plunger 15 is a piezoelectric actuator 30 which, when energized, exerts a force on a diaphragm 31. The latter bounds a fluid chamber 32 of small volume which, by means of a coupling port 33, is in communication with a work chamber 34 accommodating a piston 36 forming a terminal part of the control plunger 15. A pressure limiting (pressure maintaining) valve 35 accumulates the leakage at the piston 16 of the control plunger 15 so that the pressure is maintained in the work chamber 34 by means of the leakage clearance between the pressure limiting valve 35 and the work chamber 34. The work chamber 34 may also communicate with the pressure accumulated by the pressure limiting valve 35 by means of a non-illustrated transfer port and an also non-illustrated check valve so that liquid losses in the work chamber 34 may be compensated for.

When the piezoelectric actuator 30 is activated (energized), the diaphragm 31 is pressed slightly downwardly, thus increasing the pressure in the work chamber 34. As a result of such pressure applied to the piston 36, the control plunger 15 is moved against the force of the resetting spring 25 until the blocking piston 23 arrives into engagement with the sealing edge 21 (depicted in FIG. 2). When the actuator 30 is de-energized, the diaphragm 31 may assume its earlier position, whereupon the pressure drops in the fluid chamber 32 and thus also in the work chamber 34. As a result, the control plunger 15 is moved back by the resetting spring 25 so that the pressure equalizing piston 7 of the valve needle 4 is again charged with high pressure.

It will be understood that the above description of the present invention is susceptible to various modifications, changes and adaptations, and the same are intended to be comprehended within the meaning and range of equivalents of the appended claims.

What is claimed is:

1. A fuel injection valve for an internal combustion engine, comprising (a) a valve block;

(b) an injection nozzle carried by said valve block and being provided with a nozzle opening;

(c) a valve needle slidably disposed in said injection nozzle for assuming a closed position blocking said nozzle opening and an open position unblocking said nozzle opening;

(d) a closing spring urging said valve needle into said closed position;

(e) pressurized fluid port means defined in said valve block; said nozzle opening being in communication with said pressurized fluid port means in said open position of said valve needle for discharging pressurized fluid therefrom;

(f) a discharge port defined in said valve block for carrying fluid away from said valve block;

(g) a work chamber defined in said valve block;

(h) an equalizing piston slidably disposed in said work chamber and connected with said valve needle to move therewith; said equalizing piston having a piston face exposed to pressures prevailing in said work chamber;

(i) a control plunger movably disposed in said valve block and having a first position and a second position; in said first position said control plunger preventing communication between said discharge port and said work chamber and maintaining communication between said pressurized fluid port means and said work chamber to maintain said valve needle in said closed position; in said second position said control plunger preventing communication between said pressurized fluid port means and said work chamber and maintaining communication between said discharge port and said work chamber for displacing said equalizing piston to move said valve needle into said open position against a force of said closing spring; and (j) a throttle disposed in said discharge port for braking fluid flow from said work chamber through said discharge port.

2. A fuel injection valve for an internal combustion engine, comprising (a) a valve block;

(b) an injection nozzle carried by said valve block and being provided with a nozzle opening;

(c) a valve needle slidably disposed in said injection nozzle for assuming a closed position blocking said nozzle opening and an open position unblocking said nozzle opening;

(d) a closing spring urging said valve needle into said closed position;

(e) pressurized fluid port means defined in said valve block; said nozzle opening being in communication with said pressurized fluid port means in said open position of said valve needle for discharging pressurized fluid therefrom;

(f) a discharge port defined in said valve block for carrying fluid away from said valve block;

(g) a work chamber defined in said valve block;

(h) an equalizing piston slidably disposed in said work chamber and connected with said valve needle for moving therewith; said equalizing piston having a piston face exposed to pressure prevailing in said work chamber;

(i) a first pressure chamber defined in said valve block; said first pressure chamber being in communication with said discharge port;

(j) a second pressure chamber defined in said valve block; said second pressure chamber being in communication with said pressurized fluid port means;

(k) a transfer chamber defined in said valve block;

said transfer chamber being coupled to said first and second pressure chambers and to said work chamber;

(l) a first sealing edge disposed at said transfer chamber between said transfer chamber and said first pressure chamber;

(m) a second sealing edge disposed at said transfer chamber between said transfer chamber and said second pressure chamber;

(n) a control plunger movably disposed in said valve block and having an idle position in which said valve needle is in said closed position and an actuated position in which said valve needle is in said open position; said control plunger including (1) a first piston having a piston face bounding said first pressure chamber;

(2) a second piston having a piston face bounding said second pressure chamber; said piston faces of said first and second pistons having identical areas; and (3) a blocking piston displaceable in said transfer chamber; in said idle position of said control plunger said blocking piston sealingly engages said first sealing edge for preventing communication between said transfer chamber and said first pressure chamber and allowing communication between said work chamber and said pressurized fluid port means through said transfer chamber for maintaining said valve needle in said closed position; and in said actuated position of said control plunger said blocking piston sealingly engages said second sealing edge for preventing communication between said transfer chamber and said second pressure chamber and allowing communication between said work chamber and said discharge port through said transfer chamber for moving said valve needle into said open position;

(o) a setting member connected to said control plunger for moving said control plunger into said idle and said actuated positions thereof; and (p) a throttle disposed in said discharge port for braking fluid flow from said work chamber through said discharge port.

3. The fuel injection valve as defined in claim 2, wherein said valve block is composed of a first housing part containing said first pressure chamber and a second housing part containing said second pressure chamber; further comprising a replaceable disk having an inner periphery defining said transfer chamber; said disk being pressed by and between said first and second housing parts.

4. The fuel injection valve as defined in claim 2, wherein said valve block is composed of a first sleeve-shaped housing part containing said first pressure chamber and a second sleeve-shaped housing part containing said second pressure chamber; said housing parts being inserted into one another; further comprising (a) a replaceable intermediate layer of predetermined thickness disposed between said first and second housing parts for defining a distance between said first and second sealing edges; and (b) an elastically deformable sealing disk compressed by and between said first and second housing parts and having an inner periphery defining said transfer chamber.

* * * * *